US005885061A

United States Patent [19]

Olofsson et al.

[11] Patent Number: 5,885,061

[45] Date of Patent: Mar. 23, 1999

[54] PNEUMATIC PUMP

[75] Inventors: Sigfrid Olofsson, Munkedal; Fredrik Axelsson, Mariestad, both of Sweden

[73] Assignee: CNC—Process I Hoava AB, Hova, Sweden

[21] Appl. No.: 894,325

[22] PCT Filed: Feb. 9, 1996

[86] PCT No.: PCT/SE96/00158

§ 371 Date: Oct. 27, 1997

§ 102(e) Date: Oct. 27, 1997

[87] PCT Pub. No.: WO96/25598

PCT Pub. Date: Aug. 22, 1996

[30] Foreign Application Priority Data

Feb. 17, 1995 [SE] Sweden ..... 9500588

[51] Int. Cl.[6] ..... F04B 3/00

[52] U.S. Cl. ..... 417/260; 417/258

[58] Field of Search ..... 417/467, 469, 417/260, 261, 263, 525, 527, 258

[56] References Cited

FOREIGN PATENT DOCUMENTS 463 732 1/1991 Sweden .

*Primary Examiner*—Timothy S. Thorpe
*Assistant Examiner*—Daniel E. Moses
*Attorney, Agent, or Firm*—Pillsbury Madison & Sutro LLP

[57] ABSTRACT

A pump for compression of air includes a first inner stationary cylinder (1) arranged a second displaceable cylinder (2). A piston (3) arranged for reciprocating motion together with the first cylinder (1) divides the interior space of the first cylinder (1) into a first and a second chamber (8,9). A third cylinder (15) surrounding the second cylinder (2) is formed with a fourth chamber (16) in communication, via a passage (17), with a third chamber (12) in the second cylinder (2) and, via an inlet valve (19), with the surrounding atmosphere. Displacement of the piston rod (4) in one direction forces the air in the third chamber (12) into the first and second chambers (8,9) with resulting pressure increase in said chambers (8,9). At the same time, air is sucked into the fourth chamber (16). Upon displacement of the piston rod (4) in the opposite direction, the air in the fourth chamber (16) is forced into the third chamber (12) and further into the first chamber (8). At the same time, the air in the second chamber is forced out through a nozzle (24) via a non-return valve (21,22).

2 Claims, 3 Drawing Sheets

PNEUMATIC PUMP

Figure 1:
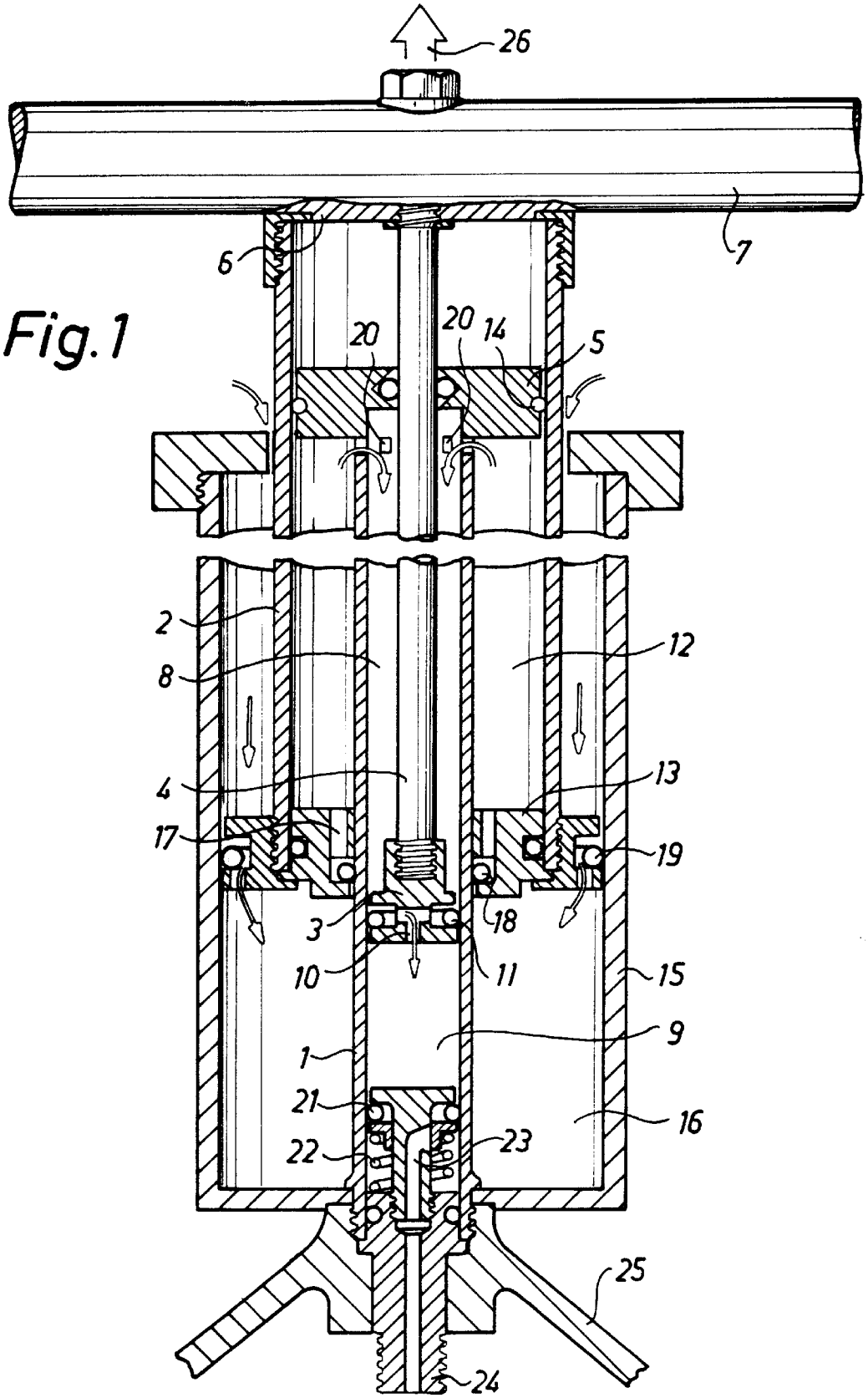

The subject invention concerns a pump for compression of air, comprising an inner stationary cylinder in which a piston, arranged for reciprocating movement in said cylinder, divides the cylinder space into two chambers, and a second cylinder, arranged for reciprocating movement about the stationary cylinder, defining a third chamber the volyme of which is several times larger than the total volume of the two first-mentioned chambers.

Manually operated pumps intended to create an excess air pressure inside a closed space are available in a great variety of different designs. Small-size pumps, such as bicycle pumps, are advantageous on account of their manageability and because the force needed for each individual pumping stroke need not be particularly strong. On the other hand, a large number of pumping strokes is needed in order to e.g. build up the required excess pressure inside a bicycle tire from the atmospheric pressure. Larger-size pumps, having ground support, while capable of transferring a larger air volume upon each pumping stroke do, however, require heavier effort on the part of the operator who therefore tires more quickly when working with this type of pump and consequently is prone to gradually pump slower and slower.

On the other hand, pumps of the kind defined above are entirely insufficient when it is desired to create high excess pressures. One example where such high excess pressures are needed is in air guns, which comprise an air container to which in accordance with prior-art technology a pressure cylinder is connected which transfers pressurized air to said container at a pressure of generally up to 200 bars. This compressed-air cylinder may be of the same type as those being part of divers' equipment.

When a pressure cylinder of this kind is used successively to build up a high excess pressure in the compressed-air container of an air gun the pressure inside the cylinder will, of course, drop, soon to reach such a low level that it becomes necessary to replenish the cylinder in order to allow it to be again used to build up the required pressure in the air gun. The replenishment of the cylinder with air to a high excess pressure level must, however, be performed in a depot particularly designed for this purpose or in a factory, where pressure testing must also be done. The marksman sees these measures and the time required therefor as complications, with the result that he may instead choose to keep a number of pressure cylinders in hand. This, in turn, involves extra expenditures on the part of the marksman. Also the transportation of the pressure cylinders is a complication to the marksman on account of the general safety regulations.

From SE-C-463 732 is already known a manually operated pump of the kind outlined in the introduction. This pump works in two steps which makes it quick-acting while at the same time only moderate forces are required to create a high excess pressure inside a container.

The invention provides a pump wich is a further development of the above Swedish Patent Specification. The characterizing features of the invention appear from the appended claims.

Figure 2:
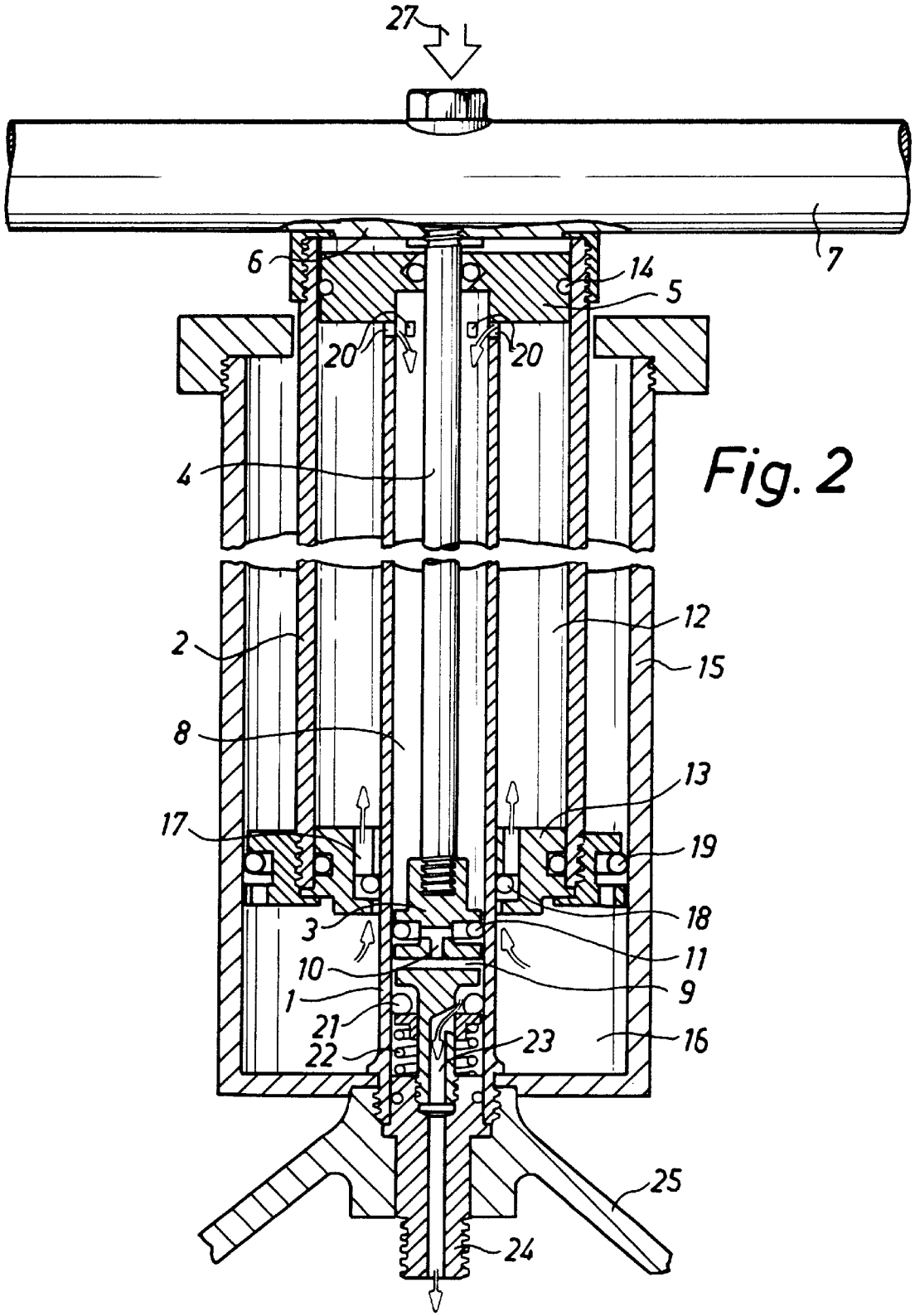
Figure 3:
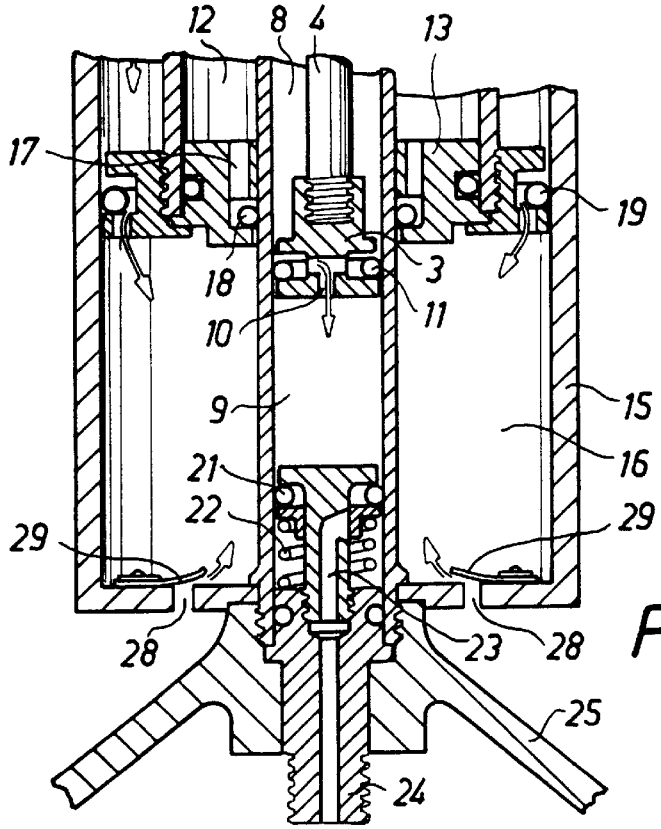
Figure 4:
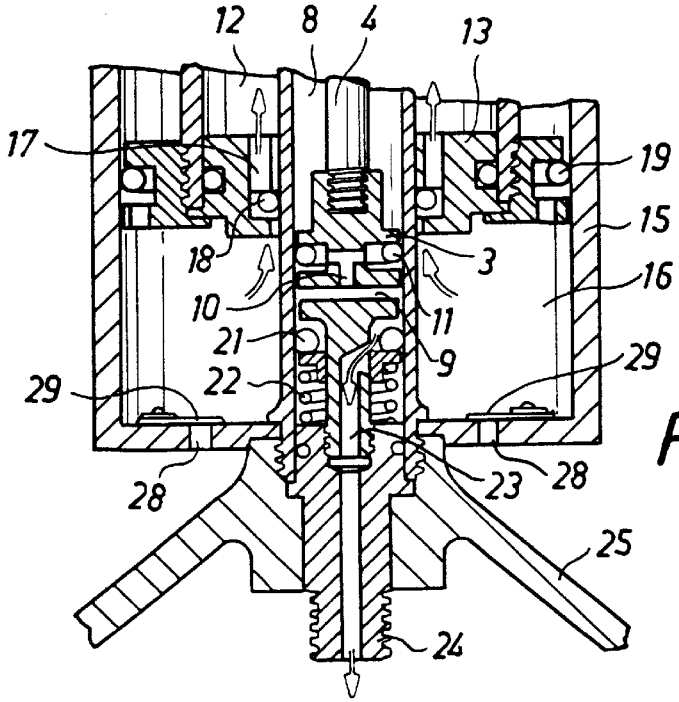

The invention will be described in closer detail in the following with reference to the accompanying drawings, wherein FIGS. 1 and 2 are longitudinal sectional views through the pump in accordance with the invention, showing two different pump positions, and FIGS. 3 and 4 are longitudinal sectional views through the lower portion of the pump in accordance with a modified embodiment thereof, and illustrate the pump in two different positions.

In accordance with prior-art technology, the pump comprises a first inner cylinder 1 which forms an elongate stationary pump housing, and a second cylinder 2 which is displaceable for reciprocating motion externally of the first cylinder and which forms a movable pump housing.

Inside the stationary cylinder 1 a piston 3 is attached to one of the ends of a piston rod 4, the latter projecting through an end wall 5 of the stationary cylinder 1, and the opposite end of the rod is mounted in one 6 of the end walls of the movable cylinder 2. By means of a pump handle 7 the movable cylinder 2 and the piston rod 4 including the piston 3 may be displaced in a reciprocating movement.

The piston 3 divides the space of the first stationary cylinder 1 into a first chamber 8 located behind the piston as seen in the pressure-exerting direction of the piston, and a second chamber 9 ahead of the piston. The first chamber 8 communicates with the second chamber 9 via a through-flow channel 10 formed in the piston 3 which is formed with a valve 11, preferably in the shape of an O-ring, sealingly abutting against the interior wall of the cylinder 1 inside the channel 10. As the piston 3 is displaced in either one of the two directions of the reciprocating motion sliding friction will cause the valve 11 to move from a position in which it closes the channel 10 to a position in which it opens the latter, and vice versa.

The second movable cylinder 2 defines a third chamber 12 about the first cylinder, intermediate an end wall 13 at the lower end of the second cylinder 2 and the end wall 5, which forms a partition wall inside the second cylinder 2 and which is equipped with a seal 14 in abutment against the interior wall of said cylinder.

In accordance with the invention, the pump is further formed with a third cylinder 15 surrounding the second cylinder 2. The third cylinder 15 comprises a chamber 16, denominated the fourth chamber, the volume of which largely exceeds the volume of the chamber 12 of the second cylinder 2. The end wall 13 has a passage 17 extending between the third chamber 12 and the fourth chamber 16. A through-passage valve 18, preferably in the form of an O-ring, is disposed in said passage 17. The O-ring sealingly abuts against the external wall of the stationary cylinder 1 and through sliding friction against said wall the O-ring is displaced to open or close the passage 17, depending on the directioon of displacement of the second cylinder 2. The third cylinder 15 is provided with a correspondingly operating inlet valve 19 arranged to close and open, respectively, the communication between the fourth chamber 16 and the surrounding air upon displacement of the second cylinder 2 in one direction or the opposite one.

Interiorly of the end or intermediate wall 5 the first cylinder 1 is formed with one or several apertures 20 through which the third chamber 12 is in communication with the first chamber 8 and through channel 10 with the second chamber 9. The latter chamber 9 is closed at its lower end by means of a non-return valve consisting of a seal 21 in sliding contact with the internal wall of the first cylinder 1 and, when affected by an excess pressure inside the chamber 9, arranged to open a channel 23 against the action of a spring 22, said channel leading outwards, through a nozzle 24. In accordance with the embodiment illustrated in the drawing figures said nozzle 24 extends through the fitting of a foot stirrup 25 or the like, only the attachment portion of which is shown in the drawings.

The mode of operation of the pump will be described in the following, reference being initially made to drawing FIG. 1. By pulling the handle 7 (in the direction of arrow 26), the second cylinder 2, the piston rod 4 and the piston 3 are displaced upwards. Owing to its sliding friction referred to above, the valve 18 will shift so as to close the passage 17, and the valve 11 will open the communication between the chambers 8 and 9. At the same time, the valve 19 will, also through sliding friction, open the communication between the surrounding air and the fourth chamber 16. The end wall 13 will approach the stationary end or partition wall 5, resulting in a successive volume reduction of third chamber 12. At the same time, the volume of the fourth chamber 16 will increase and thus air flow from the outside will flow into that chamber. In turn, the air in the third chamber 12 will flow into the first chamber 8 through the opening or openings 20 and further, via the through-flow channel 10 of the piston, into the second chamber 9. Simultaneously, the air is compressed, increasing the pressure inside the second chamber 9 to a considerably higher level than inside the third chamber 12.

When subsequently the pump handle 7 is pressed downwards (direction indicated by arrow 27, see FIG. 2), the through-flow valve 18 will open the passage 17 in response to the downwards movements of the second cylinder 2, the piston rod 4, and the piston 3 whereas valve 11 will close the channel 10 and the inlet valve 19 will cut off the fourth chamber 16 from communication with the surrounding air. Under these conditions, the piston 3 will serve as a pumping piston and increase the pressure inside the second chamber 9 sufficiently for the non-return valve 21, 22 to open, with the result that the air inside the second chamber 9 will flow outwards, through the nozzle 24. At the same time, the air inside the fourth chamber 16 will be forced through the passage 17 into the third chamber 12 and further through the openeings 20 into the first chamber 8. As soon as the pressure inside the second chamber 9 drops below a predetermined value, the spring will again close valve 21.

Upon a renewed pumping movement in the opposite direction, i.e. in the direction of arrow 26, see FIG. 1, resulting in the valves 18 and 19 again opening and the valve 11 again closing, already compressed air in the third chamber 12 and the first chamber 8 will be pumped through the channel 10 into the second chamber 9 and be further compressed therein, because this chamber 9, although expanding upon the upwards piston movement, receives the total of the air volumes in the two chambers 8 and 12.

Owing to the structural design of the invention according to which the fourth chamber 16 is considerably larger than the third chamber 12 which in turn is much larger than the sum of the volumes of the first chamber 8 and the second chamber 9, an extremely efficient pump is created. In one single pumping stroke air at a high pressure is collected in the second chamber 9. Consequently it becomes an easy task to obtain a high pressure inside a closed chamber, for instance in the air container of an air gun as mentioned in the introduction, where it has hitherto been necessary to use pressure cylinders because of the lack of manually operated pumps of sufficient efficiency and performance.

In accordance with a further development of the invention, see FIGS. 3 and 4, the third cylinder 15 is preferably formed at its lowermost part with one or several opening 28 allowing drainage of any condensing water that may form. These openings 23 are arranged to be closed airtight by means of some kind of seal, preferably a lip seal.

By choice of the dimensional relationships between the various chambers 8, 9, 12 and 16 it becomes possible to rapidly obtain either a high excess pressure inside the container to be filled with air, or in a short period of time to transfer large air volumes into said container. Thus, the invention is not limited to the dimensional relationships between the chambers appearing in the drawing figures and as described.

Although the pump in accordance with the invention is primarily intended to be used as an air pump it does of course also lend itself to pumping other gases than air. It is likewise possible to use the construction in other ways than as a manually operated pump, i.e. as a stationarily installed, power-operated pump which, owing to the leadings of the invention, will be extraordinarily powerful and performing.

We claim:

1. A pump for compression of air, comprising a first inner, stationary cylinder (1), in which a piston (3), which is arranged for reciprocating movements in said cylinder (1), divides the cylinder space into a first chamber (8) behind the piston (3), as seen the pressure-exerting direction of the piston, and a second chamber (9) ahead of the piston (3), and a second cylinder (2), which is displaceable in a reciprocating motion about the first cylinder (1) and defines a third chamber (12), the volume of which is several times larger than the total volume of the first and the second chambers (8, 9), between an end wall (13) at one of its ends and a partition wall (5) in sealing engagement with its interior wall at the opposite end of the first cylinder (1), through which partition wall (5) travels a piston rod (4) connected to the piston (3) and the second cylinder (2), which rod coordinates the movements of the piston (3) and of the second cylinder (2), said third chamber (12) communicating with the first chamber (8) via one or several openings (20) formed in the jacket of the first cylinder (1) and with the second chamber (9) via a valve (11) in said piston (3), characterized in that the pump is additionally provided with a third cylinder (15) which is rigidly connected to the first cylinder (1), said third cylinder (15) surrounding the second cylinder (2) and defining a fourth chamber (16), the volume of which largely exceeds that of the third chamber (12) and which fourth chamber communicates with the third chamber (12) via a passage (17) formed with a through-passage valve (18) between the third and the fourth chambers (12, 16) and via an inlet valve (19) with the surrounding atmosphere, and in that the pump is arranged, upon displacement of the piston rod (4) in one direction, when the through-flow valve (18) has closed said passage (17), to force the air in the third chamber (12) into the first chamber (8) via the opening or openings (20) formed in the jacket of the first cylinder (1) and into the second chamber (9) via the valve (11) of the piston (3) while increasing the pressure in said chambers (8, 9) and to simultaneously suck air into the fourth chamber (16) through the inlet valve (19) of said fourth chamber (16) and, upon displacement of the piston rod (4) in the opposite direction, to force the air in the fourth chamber (16) through the passage (17) into the third chamber (12) while closing the inlet valve (19) and opening the through-flow valve (18), and further into the first chamber (8) while simultaneously forcing the air in the second chamber (9) out through a nozzle (24) via a non-return valve (21, 22) in response to further pressure increase through closing, by means of the valve (11) of the piston (3), a through-flow channel (10) through the piston (3).

2. A pump as defined in claim 1, characterized in that at its lowermost portion the third cylinder (15) is provided with at least one opening (28) which is sealed airtight by means of a sealing member.

* * * * *

UNITED STATES PATENT AND TRADEMARK OFFICE

CERTIFICATE OF CORRECTION

PATENT NO. : 5,885,061

DATED : March 23, 1999

INVENTOR(S) : Olofsson et al.

It is certified that error appears in the above-identified patent and that said Letters Patent is hereby corrected as shown below:

On the title page, item [73] should be corrected to read --CNC-Process I Hova AB--, not "CNC-Process I Hoava AB"

Signed and Sealed this

Twenty-seventh Day of July, 1999

*Attest:*

Q. TODD DICKINSON

*Attesting Officer*

*Acting Commissioner of Patents and Trademarks*